US012319983B2

(12) United States Patent
Degel et al.

(10) Patent No.: US 12,319,983 B2
(45) Date of Patent: Jun. 3, 2025

(54) METHOD FOR GRANULATING A METALLURGICAL SLAG

(71) Applicants: SMS GROUP GMBH, Düsseldorf (DE); Monika Bergs, Rheine (DE)

(72) Inventors: Rolf Degel, Ratingen (DE); Timm Lux, Meerbusch (DE); Alexander Bergs, Rheine (DE); Nikolaus Peter Kurt Borowski, Düsseldorf (DE)

(73) Assignee: SMS GROUP GMBH, Duesseldorf (DE)

( * ) Notice: Subject to any disclaimer, the term of this patent is extended or adjusted under 35 U.S.C. 154(b) by 176 days.

(21) Appl. No.: 17/796,951

(22) PCT Filed: Jan. 28, 2021

(86) PCT No.: PCT/EP2021/051984
§ 371 (c)(1),
(2) Date: Feb. 2, 2023

(87) PCT Pub. No.: WO2021/156136
PCT Pub. Date: Aug. 12, 2021

(65) Prior Publication Data

US 2023/0392230 A1 Dec. 7, 2023

(30) Foreign Application Priority Data

Feb. 3, 2020 (DE) ..... 102020201290.3
Jul. 20, 2020 (DE) ..... 102020209057.2

(51) Int. Cl.
*C22B 7/04* (2006.01)

(52) U.S. Cl.
CPC ..... *C22B 7/04* (2013.01); *C21B 2400/026* (2018.08); *C21B 2400/062* (2018.08); *C21B 2400/08* (2018.08)

(58) Field of Classification Search
None
See application file for complete search history.

(56) References Cited

U.S. PATENT DOCUMENTS 2,255,206 A 9/1941 Duncan

FOREIGN PATENT DOCUMENTS

CN 1773204 A 5/2006
CN 107806769 A 10/2012
(Continued)

OTHER PUBLICATIONS

Machine English translation of DE102009042874, Accessed Aug. 15, 24 (Year: 2011).*
(Continued)

*Primary Examiner* — Jacob T Minskey
*Assistant Examiner* — Adrianna N Konves
(74) *Attorney, Agent, or Firm* — Amster, Rothstein & Ebenstein LLP

(57) ABSTRACT

A method for the granulation of a metallurgical slag includes blowing, from a blower or air nozzle, heated air onto liquid slag to atomize the liquid slag and subsequently form granulated slag as the atomized slag cools. The granulated slag is blown into and collected by a working chamber. In order to ensure a high quality of the granulated slag and operate in an energy-efficient manner, the atomization is provided by blowing a heated air jet free from the addition of water onto the liquid slag. The granulated slag particles are collected in the floor region of the working chamber. Air that is released from the working chamber is either supplied to a heat exchanger, which further heats the air jet blown onto the liquid slag, or the released air is directly recirculated to the blower or air nozzle in order to atomize the supply of liquid slag.

12 Claims, 5 Drawing Sheets

(56) References Cited

FOREIGN PATENT DOCUMENTS

| | | | |
|---|---|---|---|
| CN | 103773911 | A | 5/2014 |
| CN | 104404178 | A | 3/2015 |
| CN | 206570358 | U | 10/2017 |
| CS | 213297 | B1 * | 4/1982 |
| DE | 1583200 | A1 | 7/1970 |
| DE | 2735390 | C2 | 2/1978 |
| DE | 102009042874 | A1 | 4/2011 |
| JP | 54159302 | A | 12/1979 |
| JP | 5521546 | A | 2/1980 |
| JP | 5922645 | A | 2/1984 |
| JP | 11181508 | A | 7/1999 |
| JP | 11236609 | A | 8/1999 |
| TW | I520927 | B | 2/2016 |
| WO | 2011160551 | A1 | 12/2011 |
| WO | 2015184533 | A1 | 12/2015 |

OTHER PUBLICATIONS

Machine English translation of CN1773204, Accessed Aug. 15, 24 (Year: 2006).*

Machine English translation of CS213297, Accessed Aug. 15, 24 (Year: 1982).*

International Search Report, International Application No. PCT/EP2021/051984, mailed Mar. 23, 2021.

International Preliminary Report on Patentability, PCT/EP2021/051984, dated Apr. 13, 2022.

* cited by examiner

METHOD FOR GRANULATING A METALLURGICAL SLAG

CROSS REFERENCE TO RELATED APPLICATIONS

This application is a national phase of PCT application No. PCT/EP2021/051984, filed Jan. 28, 2021, which claims priority to DE 10 2020 201 290.3 filed Feb. 3, 2020, and DE 10 2020 209 057.2, filed Jul. 20, 2020, all of which are incorporated herein by reference.

FIELD OF INVENTION

The invention relates to a method for the granulation of a metallurgical slag, wherein liquid slag is atomized by blowing air onto it, and the slag particles granulated in this way are collected.

BACKGROUND OF RELATED ART

A method of this kind is known from WO 2015/184533 A1. The granulation of metallurgical slag occurs here by addition of water, wherein water is supplied to the slag by means of nozzles (see water nozzle 42 in the figure of the document) Water is also applied directly to the incoming liquid slag (see water nozzle 26 in the figure of the document).

A similar solution is shown in DE 27 35 390 C2. Here, the granulation of the slag occurs in a two-stage process, comprising for this purpose two rotary cylinders in succession. The slag is atomized by means of an air stream and blown into a first rotary tube, serving as a first waste heat boiler. The still warm granulate is then conveyed to a second rotary tube, in which it is further cooled down. The warm exhaust air from both rotary tubes is utilized to recover energy. At first, in a first step, only a very rough granulation is performed, and then the particles are treated in an intermediate grinding step. The high-temperature grinding is laborious and expensive.

Other similar solutions are shown by JP 11181508 A, DE 10 2009 042 874 A1, DE 1 583 200 A1, JP 11236609 A, JP 54159302 A, WO 2011/160551 A1 and WO 2016/095031 A1. However, all of these solutions have certain technological drawbacks, for example too low a temperature of the exhaust gas, too much dust in the exhaust gas, and a slag product which is not immediately economically usable.

In some of the known solutions, the liquid slag is thus finely atomized by means of a blower and then granulated in flight. The slag is usually atomized with water injection, i.e, the slag is sprayed with water. The granulated particles are then sufficiently cooled down as they strike the floor and possess a spherical shape. However, many of the known methods are uneconomical, so that they are not used in industrial practice.

It is the object of the invention to further develop a method of the type mentioned so that the quality of the granulate is enhanced and the costs for its production can be further reduced, especially as regards the cost of energy which must be spent on carrying out the method. Doing so aims at ensuring a high quality of the granulate in the most energy efficient manner.

SUMMARY

Achieving the object by the invention is characterized in that the atomization is done by blowing the a heated air jet free from the addition of water onto the liquid slag and the slag is supplied to a working chamber, wherein the granulated slag particles are collected in the floor region of the working chamber, wherein the air escaping from the working chamber is either supplied to a heat exchanger, which preheats the air jet blown onto the liquid slag, or directly recirculated in order to atomize the liquid slag.

Preferably, only a single working chamber is used for the method.

The slag is preferably kept free from the addition of water from supplying to depositing it in the floor region of the working chamber. Accordingly, a pure dry granulation is provided.

The air blown onto the liquid slag is preferably preheated to at least 60° C., preferably to at least 80° C., especially preferably to at least 100° C. and very preferably to at least 120° C. or the air has this temperature.

After the atomization of the liquid slag has been performed with the air, the air preferably has a temperature of at least 250° C., especially preferably at least 400° C.

A portion of the energy contained in the escaping air can also be used to supply a consumer. The consumer is, according to one embodiment of the invention, a steam generator, which is preferably connected to a steam turbine/generator system for generating electrical energy.

According to another embodiment of the invention, the consumer is a heating system, which is used to heat facilities or buildings.

According to an especially preferred embodiment of the invention a further air stream is blown onto the granulated slag particles in order to heat the air, the heated air being supplied to a heat exchanger; the slag particles are also cooled in this way. Once again, the heat recovered in the heat exchanger can be used to supply a consumer; here as well, the consumer may be a steam generator, which is preferably connected to a steam turbine/generator system for generating electrical energy, or a heating system, which is used to heat facilities or buildings.

The metallurgical slag is preferably nonferrous slag.

In order to ensure a highly clean operation, various further measures are very advantageous: accordingly, it is proposed in particular that supplying the liquid slag and blowing air onto it occurs in a first section of the working chamber (especially in the front region of the working chamber) and that the granulated slag particles accumulate in a second section of the working chamber (especially in the rear region of the working chamber), at a distance from the first section, and the air escaping from the working chamber is removed from the working chamber in the region of the first section.

For this purpose, the first section and the second section of the working chamber can be separated from each other by a baffle plate located in the ceiling region of the working chamber.

In this way, the air in the working chamber, after the granulate has trickled down, is forced back into the front region of the working chamber and then out from it, so that it hardly carries any more granulate particles. This ensures a lower dust burden.

The venting site of the escaping air advantageously is vertically above the site for supplying the liquid slag and blowing air onto it. This is understood to mean essentially that the escaping air, looking in top view, leaves the working chamber at the site where it entered. Of course, a slight offset is possible for the supplying site and the escaping site, which is preferably not greater than 2 meters, advantageously not greater than 1 meter.

The air after escaping from the working chamber can be guided at first vertically upward, then be deflected by 180°, then guided vertically downward, and then supplied again to the working chamber through the blower. This affords the further possibility of particles still present in the air to leave the air and moreover a sufficient distance which can be utilized for heat exchange from the hot air.

This concept also includes the possibility of the air, after escaping from the working chamber, being deflected at first by 90°, and then the described heat exchange occurs, after which a further deflection by 90° occurs for the purpose of being guided vertically downward.

Instead of the mentioned vertical channeling of the air, one can of course also provide a channeling at a slight angle to the vertical, preferably by as much as 30°.

An optimal removal of the resulting granulate and disposal of defective products, respectively, is facilitated by having a receiving or removal element for defective products which is located in the first section of the working chamber and at least one receiving or removal element for granulated slag particles which is located in the second section of the working chamber.

It can also be provided that the floor of the working chamber is partitioned into multiple sections, whereby two oppositely slanted floor sections in each case collect granulated slag particles with a certain parameter (especially a certain size). The granulate can then be taken away beneath the two slanted floor regions (this is shown in FIG. 4). Thus, the granulate can be separated into different classes.

Thus, with the proposed method, a dry granulation is done with preheated air. On the one hand, the slag is finely atomized and granulated, so that a commercially viable product is obtained. It is also possible to use heated air for the atomization, having been preheated by energy recovery. The air used for the atomization according to one preferred embodiment of the invention recirculates in the system. Thus, the efficiency of the overall system is increased. The granulation occurs in a single process step, so that there are advantages as compared to some of the known solutions (see above).

As compared to known solutions in which the granulation of liquid slag takes place with addition of water, the dry granulation according to the invention has the major advantage that less energy escapes from the process and thus the efficiency of the energy recovery can be improved.

The atomization of the liquid slag occurs in the dry air stream with little or no formation of filaments.

The method is suitable for use in many pyrometallurgical processes where slag is obtained. A use with nonferrous slag is especially preferred.

With the proposed solution, an optimization of the energy required for the metallurgical process can be accomplished. This is achieved by the recovery of the energy contained in the slag and which would otherwise be lost.

Hence, an effective recovery of energy from the liquid slag is ensured, and at the same time the particle of slag solidify and immediately become a valuable (marketable) granulate material. Thus, the economic utility of the slag is improved.

The blowing of air onto the liquid slag for purposes of atomization should be understood to mean that an intense air stream is introduced into the incoming flow of liquid slag, so that the desired atomization occurs. In particular, the slag is conveyed through a channel; as the slag falls out, the intense air stream is then supplied from the bottom.

BRIEF DESCRIPTION OF THE DRAWINGS

Exemplary embodiments of the invention are represented in the drawing, in which.

The aforementioned prior art offers various solutions for the technology of slag granulation and also for the recovery of energy contained in the slag. By contrast, the present invention is based on a combination of dry granulation and energy recovery.

DETAILED DESCRIPTION OF THE EMBODIMENTS

Figure 1:
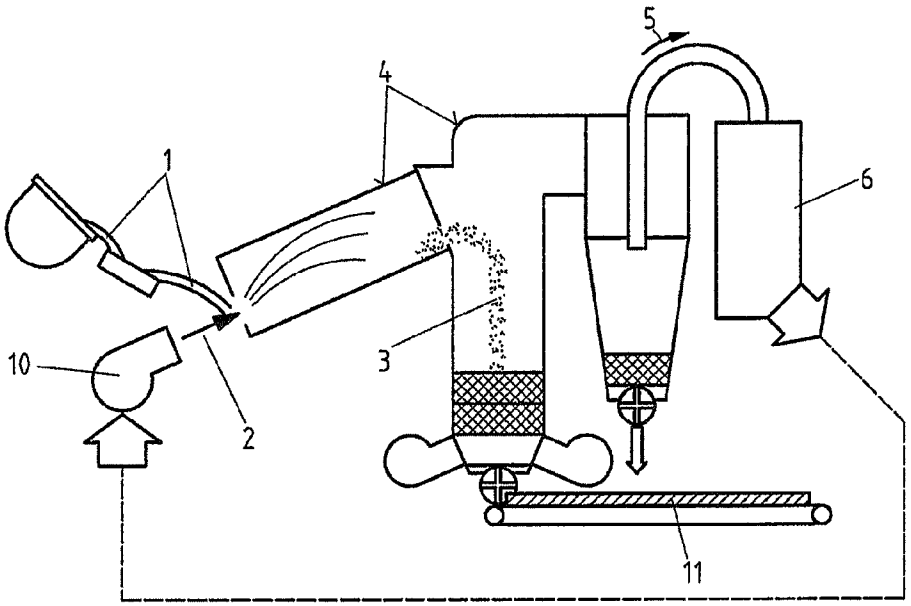
FIG. 1 shows schematically a system for the granulation of liquid slag, in which a heat recovery takes place in order to preheat the air required for the atomization of the liquid slag.

To this end, FIG. 1 shows an exemplary embodiment of the invention. Liquid slag 1 is supplied to the air flow 2 created by a blower 10. The slag 1 atomized by means of the air 2 (being present with a temperature of around 1300° C.) reaches a working chamber 4, where slag particles 3 granulated in the dry air flow are formed, and fall into the floor region of the working chamber 4 and can be transported away from underneath with a conveyor belt 11.

The air 5 escaping from the working chamber 4 (having a temperature of around 500° C.) is guided to a heat exchanger 6, where the escaping air 5 preheats intake air and guides it to the blower 10 (along the path shown schematically by broken lines) in order to atomize liquid slag 1.

Alternatively, it is also equally possible for the air 5 escaping from the working chamber 4 to be conveyed directly (without a heat exchanger) to the blower 10 and used for the atomization of the liquid slag 1. In the latter case, the air is guided in a closed circuit (recirculating) and used in its heated state for the atomizing of the liquid slag 1.

Figure 2:
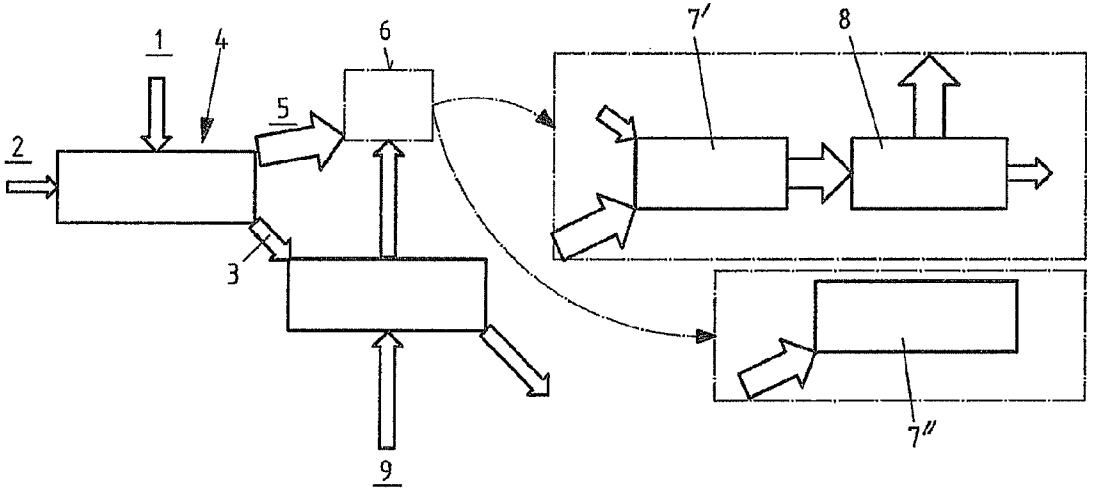
FIG. 2 shows schematically a system in which a further utilization of the recovered energy is also provided.

A combination of the two mentioned procedures is also possible: accordingly, the air 5 escaping from the working chamber 4 is recirculated, i.e., again guided to the blower 10 and used to atomize liquid slag 1. Prior, however, the escaping air 5 passed through the heat exchanger 6, so that a concept can be realized as shown in FIG. 2.

At the left of the figure, still schematically, it is illustrated how air 2 is used for atomizing the liquid slag 1. The air 5 escaping from the working chamber 4 passes through the heat exchanger 6, while the granulated slag particles 3 are collected in a floor region of the system.

At the right side of the figure it is indicated that the heat obtained from the escaping air 5 in the heat exchanger 6 is reused. Two alternative or additive possibilities are outlined for this at the right side of the figure.

In the upper area on the right side of the figure there is shown a consumer 7 in the form of a steam generator 7', in which water is evaporated by using the recovered energy.

The steam is supplied to a steam turbine/generator system 8, in which electrical energy can be produced in familiar manner.

In the lower area at right side of the figure there is shown a consumer 7 in the form of a heating system 7" The energy from the escaping air 5 is used for heating purposes in this case.

The escaping air 5 that was guided through the heat exchanger 6 can be guided back to the starting point in order to be used as air 2 for atomizing the liquid slag 1. If recirculating air is used, this air should have a temperature not less than 120° C. upon reaching the blower 10.

FIG. 2 shows yet another advantageous development of the invention. The granulated slag particles 3 accumulating in the floor region of the working chamber 4 at first still have a temperature of around 500° C. This effect can be utilized for further heat recovery.

For this purpose, a further air stream 9 is guided through the bottom region, which heats up as it is passed through the slag particles 3 and supplied to a heat exchanger 6 (this may be the same heat exchanger as mentioned above, as shown, but it can also be a separate one). The heat from the heated air stream 9 can be utilized in the described manner and be made available to one or more consumers 7. It is desirable to remove as much heat as possible from the slag particles by the further air stream 9, so that the slag particles only have a temperature of around 80° C.

Of course, the removal of heat from the slag particles need not occur directly in the floor region of the working chamber 4. It is also possible to select a downstream location for this purpose, such as the region of the conveyor belt 11.

It would also be possible to utilize the heated further air stream 9 by supplying it to the blower 10 and performing the atomization of the liquid slag 1 by means of the air which has thus been preheated.

Figure 3:
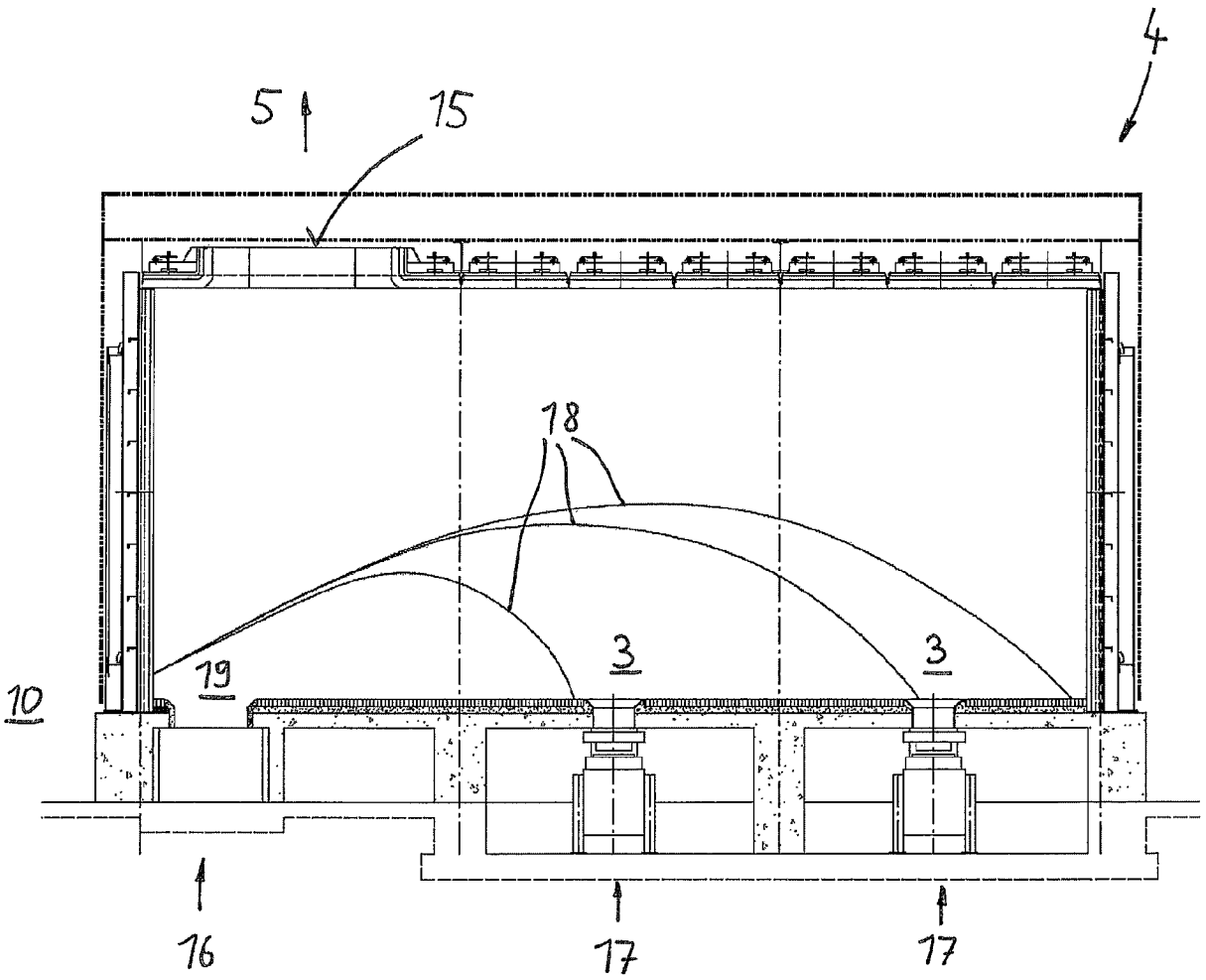
FIG. 3 shows schematically a side view of the working chamber of the system, indicating the flight of the granulated slag particles after air has been blown onto them.

FIG. 3 shows the working chamber 4 once more in further detail, indicating by flight parabolas 18 how the granulated slag particles 3, by blowing air onto them, are moving from the (left) end region of the working chamber 4 and then accumulate in the floor region of the working chamber 4. Defective products 19 mostly fall down directly in the air injection region and accumulate in a location from which they can be disposed (especially in the form of a drop hatch beneath the slag channel). Thus, a receiving or removal element 16 for these defective products 19 is arranged here. The properly granulated slag particles 3, however, accumulate in other locations of the floor and are removed here by receiving or removal elements 17 from the working chamber 4. The removal site 15 for the air 5 escaping from the working chamber 4 again is in the region of the air inlet site, i.e., in the left region of the working chamber 4; the air is thus guided in a special manner (cf., FIG. 4). FIG. 3 provides one configuration of the floor of the working chamber 4, where the floor has a straight shape. The granulated slag particles 3 can be transported away either by a wheel loader, by manual unloading, or by an extraction device on the floor.

Figure 4:
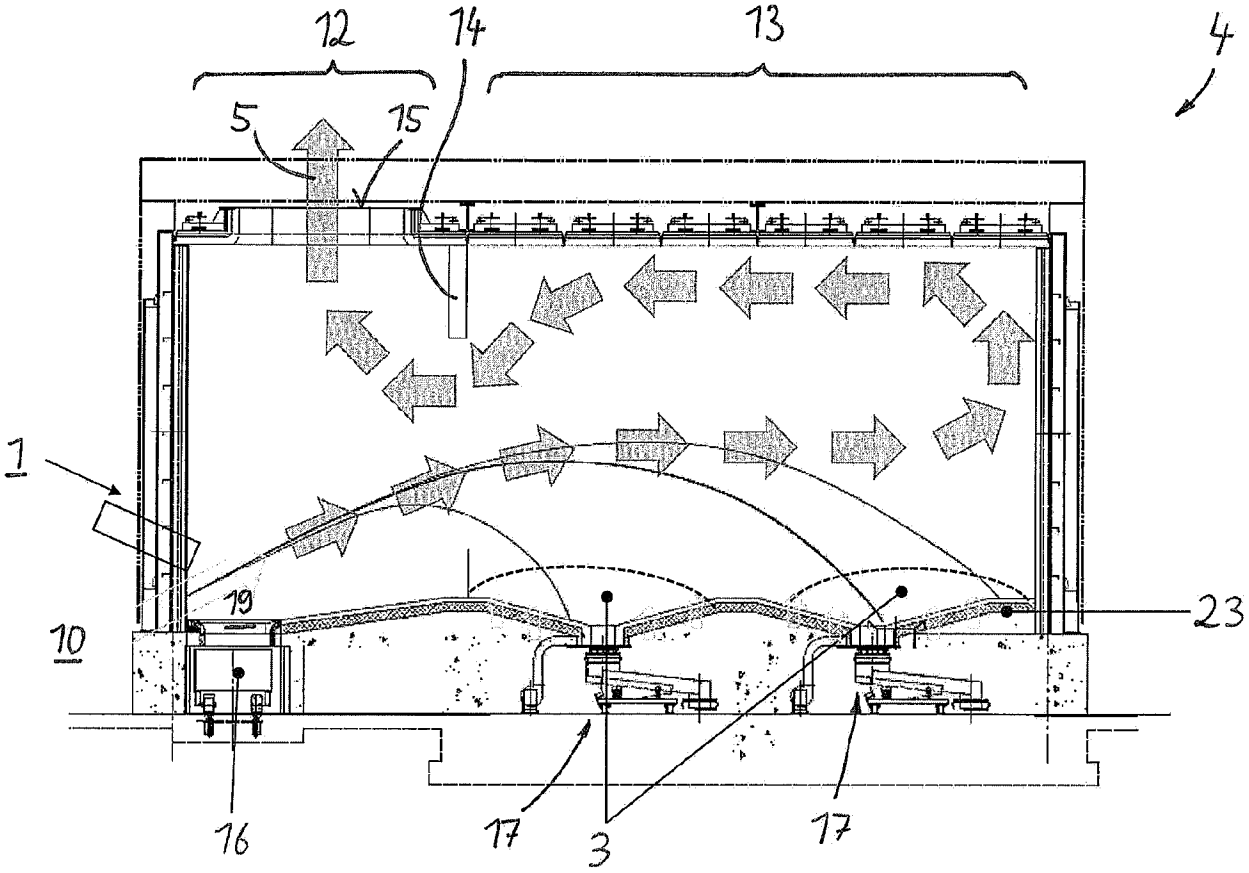
FIG. 4 shows schematically a side view of the working chamber in an alternative embodiment, where the course of the flow of air through the working chamber and out from it is indicated.

FIG. 4 shows an alternative configuration. As regards the design of the floor of the working chamber 4, it is evident from the figure that the floor has slight sloping surfaces by which the working chamber 4 is divided into segments or sections in which different product sizes can be roughly separated and transported to separate outlets.

In either case, the floor of the working chamber can be configured either as a simple sheet or as a perforated sheet in order to pass air through the resulting granulate material, so that it becomes possible on the one hand to further cool the granulate material and on the other hand to also remove further energy from the granulate material, which can then be utilized elsewhere (see above). The perforated sheet is designated as the air baffle 23 in FIG. 4.

FIG. 4 furthermore shows how the air blown in from the blower 10 reaches the working chamber 4, is guided therein, and then exits again through the removal site 15. Accordingly, the working chamber 4 is divided into a first section 12 and a second section 13. The two sections in the exemplary embodiment are separated from each other by a baffle plate 14, which is arranged in the ceiling region of the working chamber 4. The first section 12 is in the region where the air and the liquid slag 1 are introduced into the working chamber 4; the length of the first section 12 is preferably between 15% and 35% of the overall length of the working chamber 4, length meaning here the width of the working chamber 4 as viewed according to FIG. 4.

As a result, the air enters into the working chamber in the left end region of the working chamber 4 (see FIG. 4) and takes the path shown by the arrows. The air must then flow around the baffle plate 14 and reaches the removal site 15, where it escapes from the working chamber 4. This ensures that only a minimal fraction of granulate material or dust is present in the air 5 when it leaves the working chamber.

Figure 5:
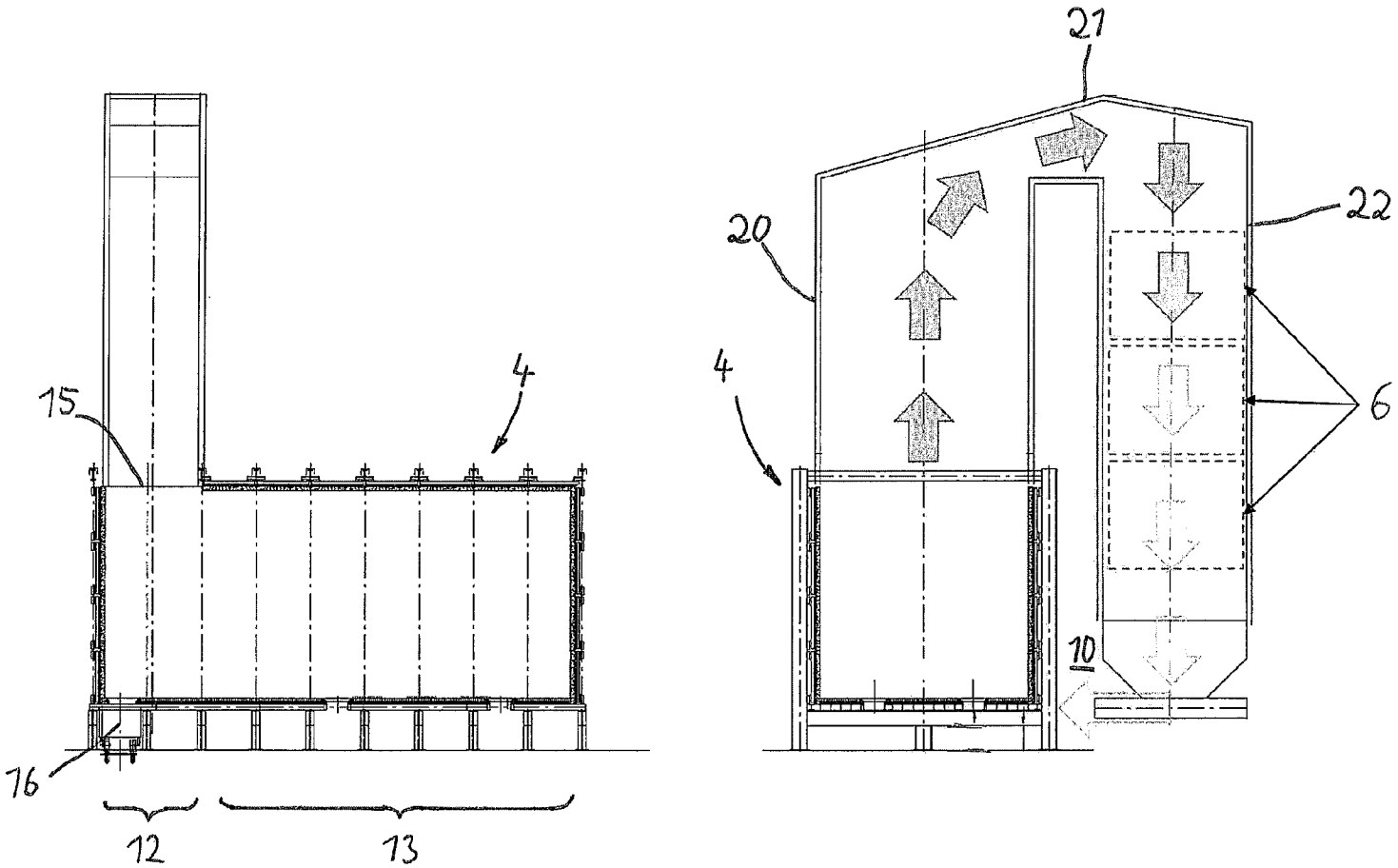
FIG. 5 shows schematically a side view (left) and a front view (right) of the working chamber and the later route of the air including a heat exchanger.

FIG. 5 shows how the hot air is advantageously guided as soon as it has left the working chamber 4. As can be seen from considering both the side view (left side of FIG. 5) and the front view (right side of FIG. 5), the air, after leaving the working chamber 4 at the removal site 15, is at first guided vertically upward along a first section 20 of the air conduit. At the end of the section 20 there is arranged a deflection point 21, by which the air is deflected by 180° and guided into a second section of the air conduit 22, which guides the air vertically downward. At the lower end, the air is returned to the blower 10, which blows it once more into the working chamber 4. An especially convenient site for the arrangement of the heat exchanger 6 is located in the region of the second section 22 of the air conduit.

LIST OF REFERENCE NUMERALS

1 Liquid slag
2 Air
3 Granulated slag particles
4 Working chamber
5 Air escaping from the working chamber
6 Heat exchanger
7 Consumer
7' Steam generator
7" Heating system
8 Steam turbine/generator system
9 Further air stream
10 Blower
11 Conveyor belt
12 First section of the working chamber
13 Second section of the working chamber
14 Baffle plate
15 Removal site for escaping air
16 Receiving or removal element for defective products
17 Receiving or removal element for granulated slag particles
18 Flight parabola
19 Defective product
20 First section of the air conduit
21 Deflection
22 Second section of the air conduit
23 Air baffle

We claim:

1. A method for the granulation of a metallurgical slag, the method comprising:

blowing, from a blower, heated air onto a supply of liquid slag such that the liquid slag is transformed to atomized slag, wherein atomization is provided by blowing the heated air free of water onto the liquid slag;

directing the atomized slag into a single working chamber in which the atomized slag forms into granulated slag particles which are collected in a floor region of the single working chamber;

releasing, from the single working chamber, the heated air either to a heat exchanger, which further heats the released air and directs the further heated released air to an air inlet of the blower for blowing onto the liquid slag, or directly recirculating the released air from the single working chamber to the air inlet of the blower in order to atomize the liquid slag; and wherein the supply of the liquid slag and the blowing of heated air from the blower onto the liquid slag occurs in a first section of the single working chamber and the granulated slag particles accumulate in a second section of the single working chamber, at a distance from the first section, wherein the released air from the single working chamber is removed from the single working chamber in a region of the first section, and wherein the first section and the second section of the single working chamber are separated from each other by a baffle plate located in a ceiling region of the single working chamber, wherein a portion of energy contained in the released air is used to supply a consumer.

2. The method according to claim 1, wherein the liquid slag is kept free from water from the supply of slag and through formation and accumulation of granulated slag particles on the floor region of the single working chamber.

3. The method according to claim 1, wherein the heated air used to blow onto the liquid slag is preheated to at least 60° C.

4. The method according to claim 1, wherein the heated air, after having been used for the atomization of the liquid slag, has a temperature of at least 250° C.

5. The method according to claim 1, wherein the consumer is a steam generator that is connected to a steam turbine/generator system for generating electrical energy.

6. The method according to claim 1, wherein the further heated released air from the heat exchanger is blown onto the granulated slag particles from a secondary air inlet.

7. The method according to claim 6, wherein heat recovered in the heat exchanger is used to supply the consumer.

8. The method according to claim 1, wherein the consumer is a heating system which is used for heating facilities or buildings.

9. The method according to claim 1, wherein the metallurgical slag is a nonferrous slag.

10. The method according to claim 1, wherein a venting site provided in the region of the first section for the released air is vertically above a site for supplying the liquid slag and blowing the heated air onto the supply of liquid slag.

11. The method according to claim 1, wherein the released air from the single working chamber is guided vertically upward, then deflected by 180°, then guided vertically downward, and then supplied again to the single working chamber through the blower.

12. The method according to claim 1, wherein a receiving or removal element for defective products is located in the first section of the single working chamber and at least one receiving or removal element for granulated slag particles is located in the second section of the single working chamber.

* * * * *